US008251779B2

(12) United States Patent
Pei

(10) Patent No.: US 8,251,779 B2
(45) Date of Patent: Aug. 28, 2012

(54) GRINDING DEVICE WITH CLEANING ASSEMBLY

(75) Inventor: Shao-Kai Pei, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 354 days.

(21) Appl. No.: 12/728,255

(22) Filed: Mar. 21, 2010

(65) Prior Publication Data

US 2011/0053472 A1 Mar. 3, 2011

(30) Foreign Application Priority Data

Aug. 25, 2009 (CN) ..... 2009 1 0306010

(51) Int. Cl.
*B24B 7/00* (2006.01)

(52) U.S. Cl. ..... 451/120; 451/27; 451/51; 451/142; 451/67; 451/388; 451/449

(58) Field of Classification Search ..... 451/27, 451/51, 61, 67, 120, 142, 231, 388, 449, 451/442

See application file for complete search history.

(56) References Cited

U.S. PATENT DOCUMENTS

| | | | | | |
|---|---|---|---|---|---|
| 2,811,995 | A * | 11/1957 | Bremmer | 99/626 |
| 3,855,916 | A * | 12/1974 | Lazzarini | 99/623 |
| 4,795,496 | A * | 1/1989 | Karaki et al. | 134/8 |
| 5,679,061 | A * | 10/1997 | Thielenhaus | 451/51 |
| 6,012,973 | A * | 1/2000 | Nagel | 451/51 |
| 6,287,183 | B1 * | 9/2001 | Zhang et al. | 451/407 |
| 6,615,613 | B1 * | 9/2003 | Iwabuchi et al. | 65/61 |
| 2011/0065367 | A1 * | 3/2011 | Pei | 451/233 |

* cited by examiner

*Primary Examiner* — George Nguyen
(74) *Attorney, Agent, or Firm* — Altis Law Group, Inc.

(57) ABSTRACT

An exemplary grinding device includes a fixed barrel, a rotatable barrel, a grinding plate, an actuator and a cleaning assembly. The fixed barrel defines a chamber and includes a number of inner sidewall substantially parallel to a central axis, each of which defines a holding groove for holding a workpiece. The rotatable barrel is received in the chamber and includes an outer side substantially parallel to the central axis and defines an installation groove. The grinding plate is installed in each of the installation grooves. The actuator is configured for driving the rotatable barrel to rotate and simultaneously move up and down in the first chamber, such that the grinding plates contact the workpieces and grind the workpieces. The cleaning assembly is situated under the fixed barrel for cleaning the workpieces.

18 Claims, 5 Drawing Sheets

GRINDING DEVICE WITH CLEANING ASSEMBLY

BACKGROUND

1. Technical Field

The present disclosure relates to grinding devices such as those used for forming arc-shaped surfaces in workpieces.

2. Description of Related Art

A typical surface grinding device for grinding arc-shaped surfaces (hereinafter, "arc surfaces") generally includes a bed with a fixture for holding one or more workpieces, and a grinding mechanism for grinding surfaces of the workpieces into desired arc shapes. To increase efficiency, a large size bed is provided to hold many workpieces at one time. In such case, the grinding mechanism is moved to grind the workpieces continuously one after another, or more grinding mechanisms are employed to grind the workpieces simultaneously. However, the large size bed occupies much space. Furthermore, in a typical process, after the grinding is completed, operators must move the workpieces to a cleaning device to clean the workpieces. Thus the surface grinding device is rather bulky, time-consuming, and inefficient.

Therefore, it is desirable to provide a grinding device which can overcome the above-mentioned problems.

BRIEF DESCRIPTION OF THE DRAWINGS

Many aspects of the present grinding device can be better understood with reference to the accompanying drawings. The components in the drawings are not necessarily drawn to scale, the emphasis instead being placed upon clearly illustrating the principles of the present grinding device. Moreover, in the drawings, like reference numerals designate corresponding parts throughout the several views, and all the views are schematic.

DETAILED DESCRIPTION

Embodiments of the present grinding device will now be described in detail below, and with reference to the drawings.

Figure 1:
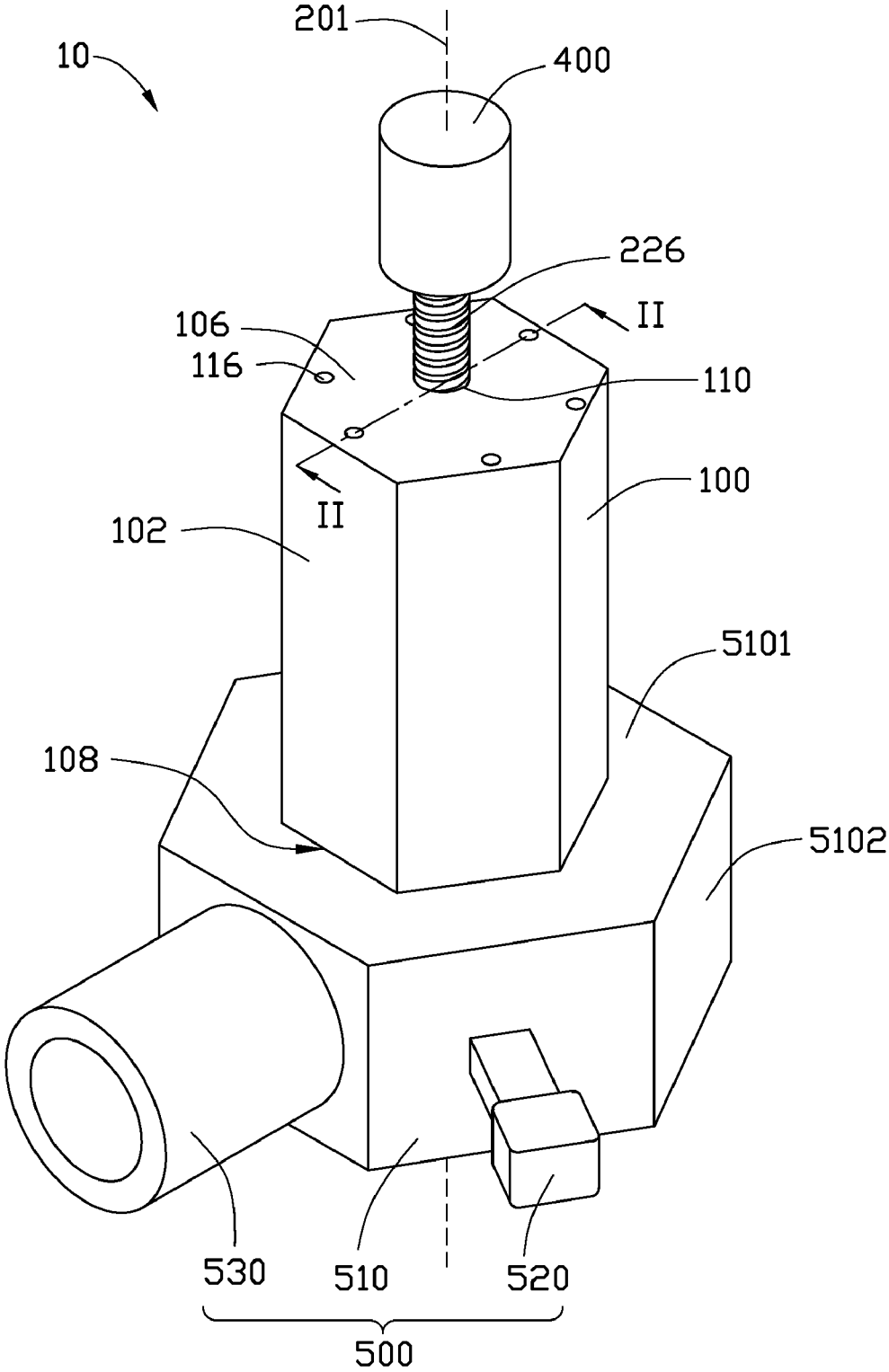
FIG. 1 is an isometric view of a grinding device according to an exemplary embodiment, the grinding device including a fixed barrel, a rotatable barrel, a pair of grinding plates (not visible), and a cleaning assembly.
Figure 2:
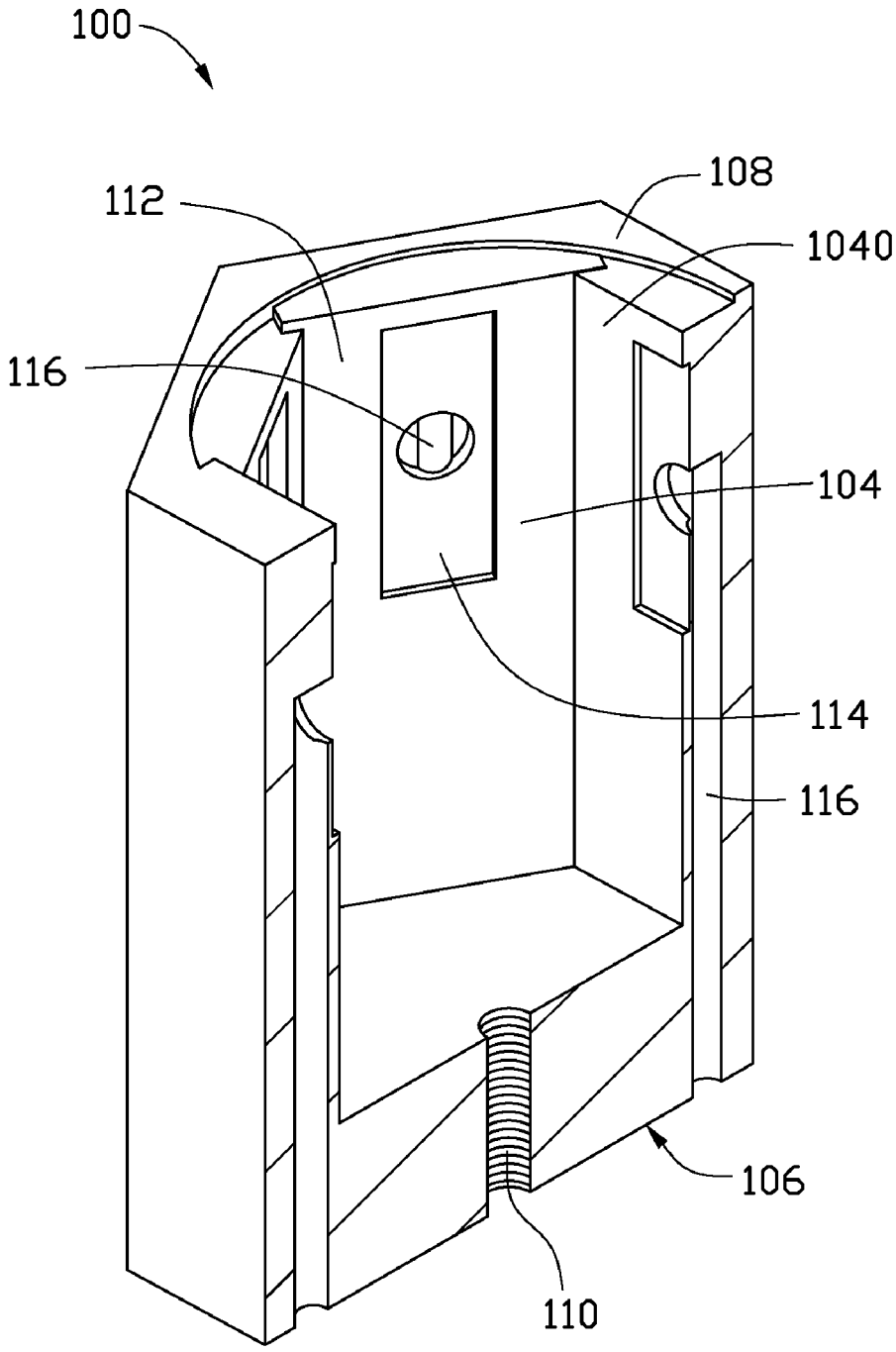
FIG. 2 is a cutaway view of the fixed barrel of FIG. 1, with the fixed barrel inverted and the view corresponding to line II-II of FIG. 1.
Figure 3:
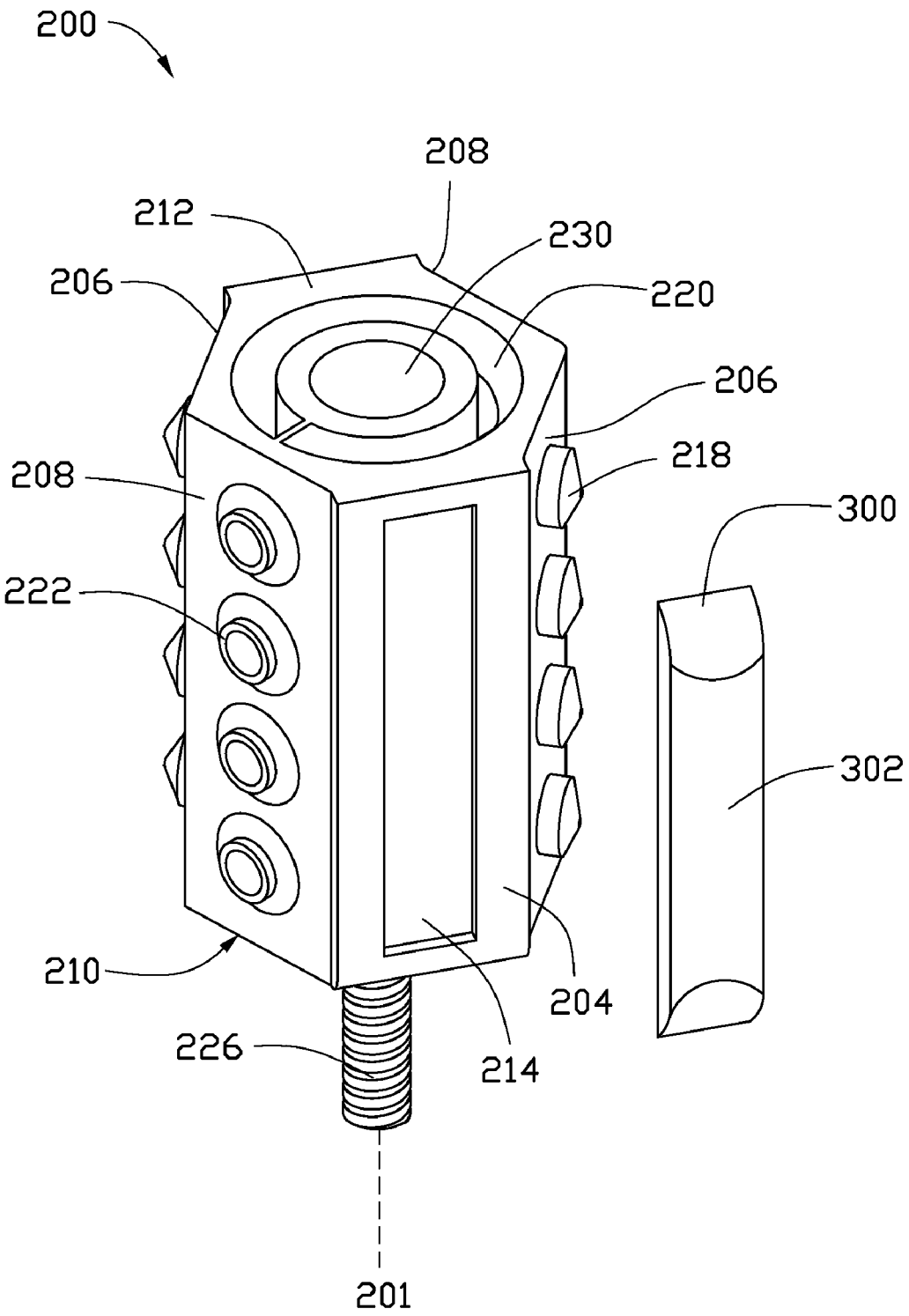
FIG. 3 is an isometric, inverted view of the rotatable barrel of the grinding device of FIG. 1, showing one of the grinding plates exploded away therefrom.

Referring to FIGS. 1-3, a grinding device 10, according to an exemplary embodiment, is configured for simultaneously grinding surfaces of a number of workpieces (not shown) into desired arc shapes. The grinding device 10 includes a fixed barrel 100, a rotatable barrel 200, a number of grinding plates 300 (see also FIG. 4), an actuator 400, and a cleaning assembly 500.

The fixed barrel 100 includes a first main body 102, which is generally a hexagonal prism in shape and symmetrical about a central axis 201 of the fixed barrel 100. The first main body 102 is hollow and includes a top plate 106 and a bottom plate 108.

The first main body 102 defines a first chamber 104. In the present disclosure, the first chamber 104 is generally a hexagonal prism in shape, and is symmetrical about the central axis 201. The first chamber 104 has an opening 1040 formed in the bottom plate 108. Each of sidewalls 112 of the first chamber 104 defines a holding groove 114. The holding groove 114 is shaped corresponding to a workpiece and is configured for receiving the workpiece. In the present embodiment, the holding groove 114 is rectangular, with the lengthwise direction being substantially parallel to the central axis 201. A number of suction holes 116 are provided. Each of the suction holes 116 spans from a middle of an indented face of the holding groove 114 to the top plate 106 of the fixed barrel 100. Each suction hole 116 communicates a corresponding holding groove 114 to an external vacuum source (not shown) via an airway (not shown). The top plate 106 defines a threaded hole 110 in the middle thereof.

It is noteworthy that the present embodiment having the first chamber 104 is not limiting. In alternative embodiments, to reduce or increase the number of sidewalls 112 for holding fewer or more workpieces, other types of regular prism chambers, such as octagonal prism chambers, can be employed.

The number, the shape and the arrangement of the holding grooves 114 as illustrated are not limiting either. In alternative embodiments, more holding grooves 114 can be defined in a sidewall 112, and can be arranged in a suitable desired fashion. Also, the holding grooves 114 can be selectively defined in several of the sidewalls 112.

It is also noteworthy that, while in the present embodiment the suction holes 116 are configured for fixedly holding the workpieces in the holding grooves 114, other ways to hold the workpieces are also contemplated. In alternative embodiments, the suction holes 116 are replaced by other suitable fastening structures which fixedly hold the workpieces in the holding grooves 114.

Figure 4:
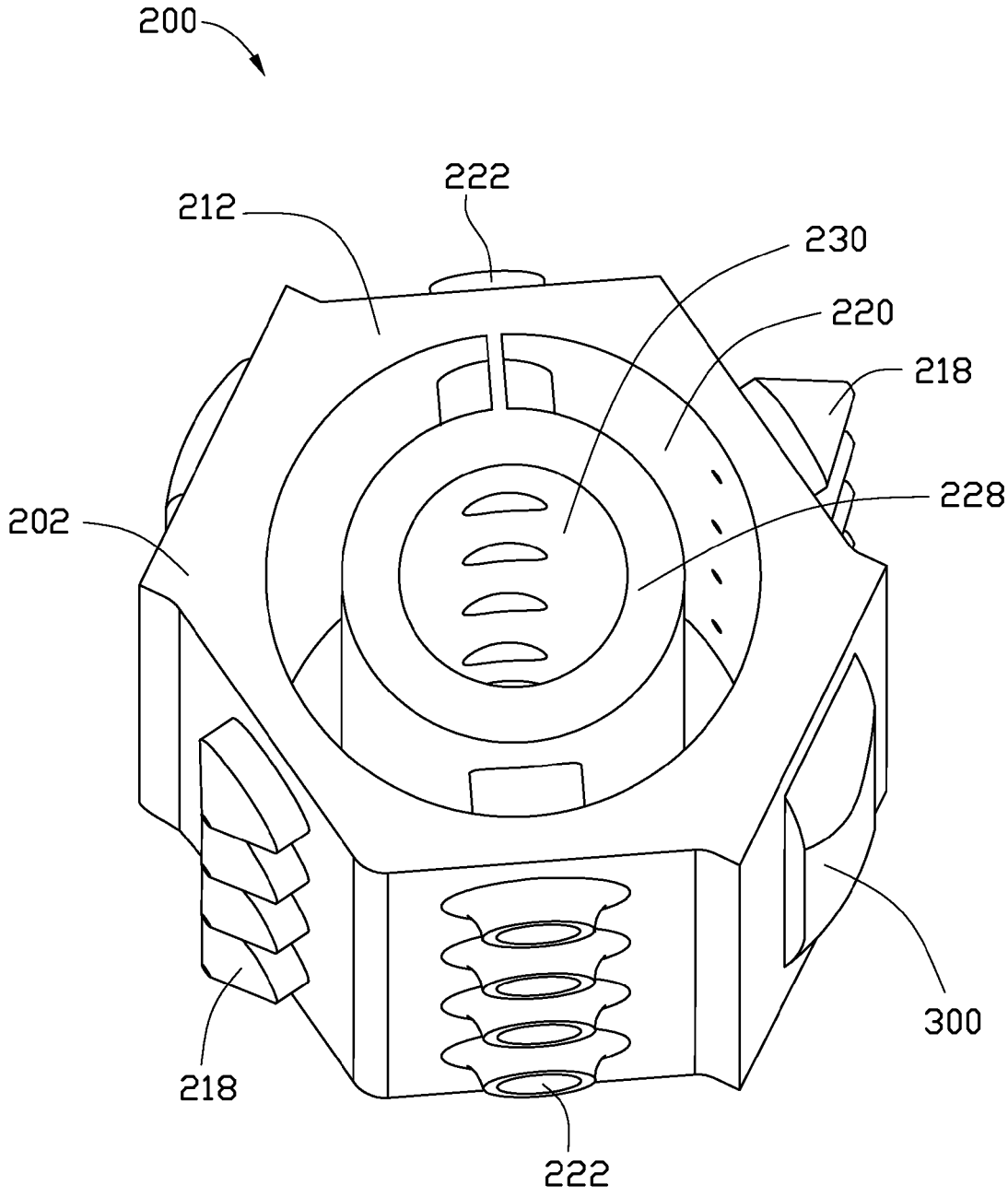
FIG. 4 is similar to FIG. 3, but showing the parts assembled and viewed from a higher angle.

Also referring to FIG. 4, the rotatable barrel 200 is received in the first chamber 104. The rotatable barrel 200 includes a second main body 202 centered on the central axis 201. In particular, the second main body 202 is generally a hexagonal prism in shape, and includes an upper surface 210, a lower surface 212, two opposite first outer sides 204, two opposite second outer sides 206, and two opposite third outer sides 208.

Each of the first outer sides 204 is substantially parallel to the central axis 201, and defines an installation groove 214 for installing a corresponding grinding plate 300 therein. The installation grooves 214 are shaped corresponding to the shapes of the grinding plates 300. In this embodiment, the installation grooves 214 are rectangular, with the lengthwise directions being substantially parallel to the central axis 201.

It should be noted that the number of installation grooves 214 as illustrated is not limiting. In alternative embodiments, more installation grooves 214 can be defined in each first outer side 204, and can be arranged in a suitable desired fashion.

A number of water nozzles 218 protrude outward from each of the second outer sides 206 of the second main body 202. In each second outer side 206, the water nozzles 218 are arranged in a line along a middle of the second outer side 206, the line being parallel to the central axis 201.

Figure 5:
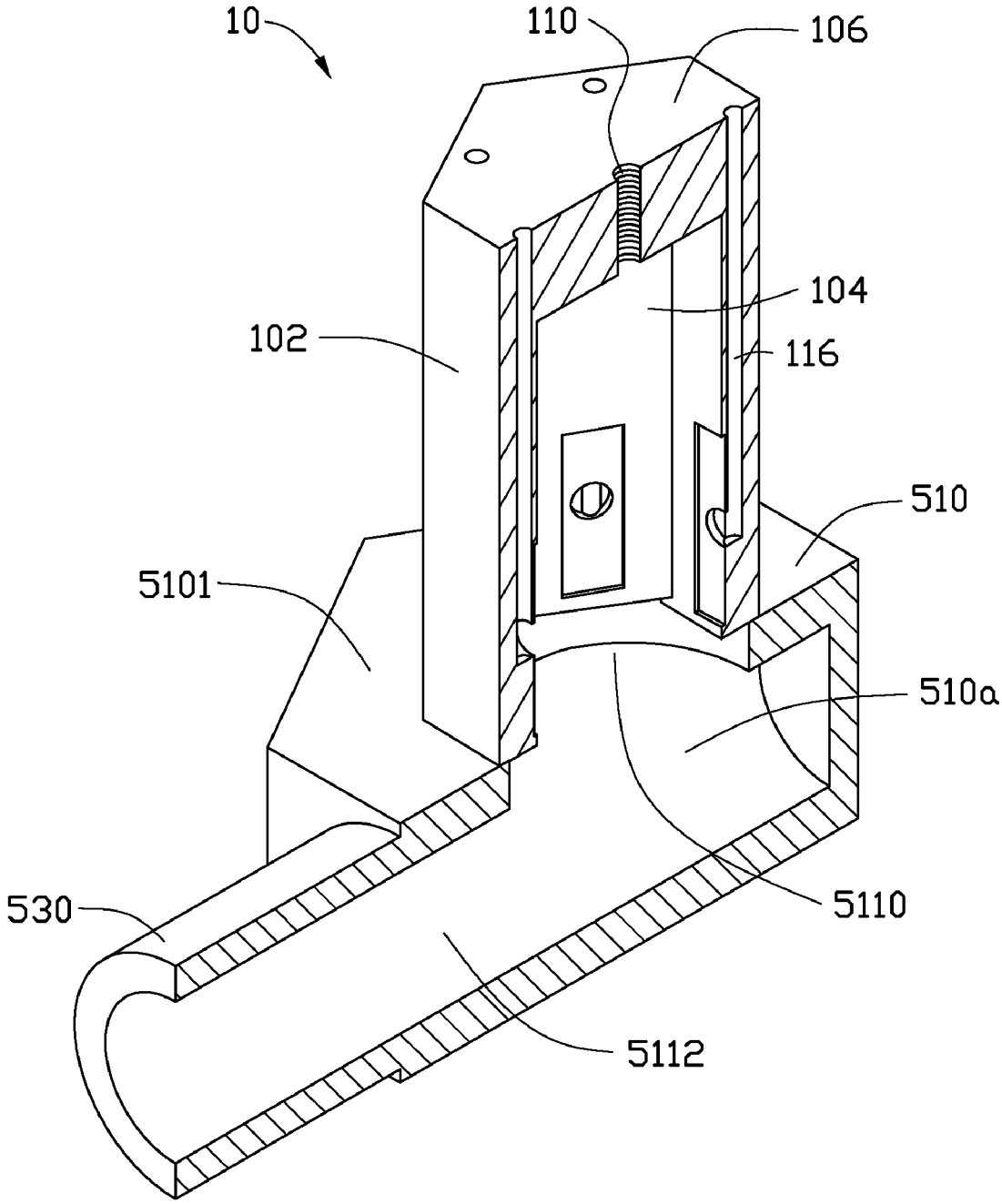
FIG. 5 is a cutaway view of the fixed barrel and the cleaning assembly of FIG. 1.

Also referring to FIG. 5, the rotatable barrel 200 further includes an inner tube 228. The inner tube 228 is received in the second main body 202, and is centered on the central axis 201. A water chamber 220 is formed between the second main body 202 and the inner tube 228. The inner tube 228 defines a grease chamber 230 therein. The grease chamber 230 stores a grease source (not shown). The water nozzles 218 communicate with the water chamber 220 to spray water on the workpieces when the workpieces are being ground.

A number of grease nozzles 222 protrude outward from each of the third outer sides 208 of the second main body 202. At each third outer side 208, the grease nozzles 222 are arranged in a line along a middle of the third outer side 208, the line being parallel to the central axis 201. The grease nozzles 222 communicate with the grease chamber 230 to spray the grease onto the workpieces when the workpieces are being ground.

A threaded shaft 226 protrudes upwardly from the upper surface 210 of the rotatable barrel 200 along the central axis 201. The threaded shaft 226 engages with and passes through the threaded hole 110 of the first main body 102.

Each of the grinding plates 300 includes an arc abrading surface 302. Referring back to FIG. 3, the grinding plates 300 are installed in the installation grooves 214. The arc surfaces 302 of the grinding plates 300 grind the workpieces when the grinding plates 300 are moved and rotated to contact the workpieces.

Referring back to FIG. 1, the actuator 400 is mounted above the top plate 106 of the first main body 102. The threaded shaft 226 is fixed to the actuator 400, so that the actuator 400 drives the threaded shaft 226 to rotate. The total length of the threaded shaft 226 and the rotatable barrel 200 is longer than that of the first chamber 104. The actuator 400 rotates and moves the rotatable barrel 200 up and down in the first chamber 104, so that the grinding plates 300 contact the workpieces and grind the workpieces.

Referring to FIGS. 1 and 5, the cleaning assembly 500 is situated under the fixed barrel 100. The cleaning assembly 500 includes a housing 510, a vibrating member 520, and a pipe 530. The housing 510 defines a receiving chamber 510*a*. The housing 510 is generally a hexagonal prism in shape, and includes a supporting surface 5101 and six sidewalls 5102. The supporting surface 5101 defines a first opening 5110 thereat. The fixed barrel 100 is detachably fixed on the supporting surface 5101 of the housing 510. The receiving chamber 510*a* communicates with the opening 1040 of the first chamber 104 via the first opening 5110. One of the sidewalls 5102 defines a second opening 5112. An end of the pipe 530 integrally extends from such sidewall 5102 at the second opening 5112, and communicates with the receiving chamber 510*a*. In an alternative embodiment, an end of the pipe 530 is hermetically sleeved in the second opening 5112 of the sidewall 5102. The vibrating member 520 is mounted on another sidewall 5102 of the receiving chamber 510*a*. In this embodiment, the vibrating member 520 is an ultrasonic device, which is configured to vibrate cleaning fluid, such as water, in the fixed barrel 100 to clean the workpieces.

In use, first, the workpieces are placed in the holding grooves 114, with a vacuum source connected to the suction holes 116 via the airways (not shown) and activated to apply suction to the workpieces so that the workpieces are fixedly held in the holding grooves 114. The actuator 400 is started up, and rotates and moves along the central axis 201. The actuator 400 thereby drives the rotatable barrel 200 to rotate, so that the arc surfaces 302 of the grinding plates 300 contact the workpieces and grind the workpieces. After grinding, a water source is connected to the pipe 530, and water flows into the receiving chamber 510*a* and the first chamber 104 to cover the workpieces. The vibrating member 520 is activated to vibrate the water in the fixed barrel 100 to clean the workpieces. Finally, the fixed barrel 100 is removed from the supporting surface 5101 of the housing 510, and the workpieces are removed from the first chamber 104.

Unlike with conventional grinders, the grinding device 10 of the present disclosure holds a number of workpieces in the fixed barrel 100 and grinds the workpieces simultaneously. This reduces the amount of space needed for the grinding device 10, and reduces the amount of space and the time needed for the grinding device 10 to operate and grind the workpieces.

It will be understood that the above particular embodiments and methods are shown and described by way of illustration only. The principles and the features of the present invention may be employed in various and numerous embodiments thereof without departing from the scope of the invention as claimed. The above-described embodiments illustrate the scope of the invention but do not restrict the scope of the invention.

What is claimed is:

1. A grinding device, comprising:

a fixed barrel defining a first chamber therein and comprising a plurality of sidewalls, the sidewalls being substantially parallel to an axis of the fixed barrel, an inner face of each of the sidewalls defining a holding groove therein for holding a workpiece;

a rotatable barrel received in the first chamber and comprising two first outer sides, each of the first outer sides being substantially parallel to the axis and defining an installation groove;

a grinding plate installed in each of the installation grooves;

an actuator operatively connected to the rotatable barrel to drive the rotatable barrel to rotate and simultaneously move up and down in the first chamber such that the grinding plates contact surfaces of the workpieces and grind the surfaces of the workpieces into desired arc shapes; and a cleaning assembly comprising a housing and a pipe, the housing defining a receiving chamber, the housing comprising a top on which the fixed barrel is fixed and at least one peripheral sidewall, the top defining a first opening via which the receiving chamber communicates with the first chamber, at least one sidewall of the at least one sidewall defining a second opening, the pipe extending from said at least one sidewall of the at least one sidewall such that the pipe communicates with the receiving chamber, and the pipe capable of conveying liquid into the receiving chamber and the first chamber to clean the workpieces.

2. The grinding device of claim 1, wherein the fixed barrel comprises a hollow first main body, the first main body comprises the sidewalls and a top plate, and the sidewalls and the top plate define a plurality of suction holes spanning from the holding grooves through to a top surface of the top plate.

3. The grinding device of claim 1, wherein the rotatable barrel further comprises a second main body and an inner tube, the second main body comprises the two first outer sides and two second outer sides, the inner tube is formed in the second main body, the second main body and the inner tube cooperatively define a water chamber therebetween, a water nozzle protrudes outwards from each of the second outer sides, and the water nozzles communicate with the water chamber to spray water on the workpieces when the workpieces are being ground.

4. The grinding device of claim 3, wherein the inner tube defines a grease chamber therein, the second main body of the rotatable barrel further comprises two third outer sides, a grease nozzle protrudes outwards from each of the third outer sides, and the grease nozzles communicate with the grease chamber to spray grease on the workpieces when the workpieces are being ground.

5. The grinding device of claim 1, wherein each of the grinding plates comprises an arc abrading surface for grinding the workpieces.

6. The grinding device of claim 1, wherein the cleaning assembly further comprises a vibrating member mounted on at least one sidewall of the at least one sidewall of the housing, and the vibrating member is configured to vibrating water in the fixed barrel to clean the workpieces.

7. The grinding device of claim 6, wherein the vibrating member is an ultrasonic device.

8. The grinding device of claim 2, wherein the top plate of the fixed barrel defines a threaded hole, a threaded shaft protrudes upwardly from the rotatable barrel along the axis, the threaded shaft passes through and is movably engaged in the threaded hole of the fixed barrel, and the threaded shaft is connected to the actuator, whereby the actuator is operatively connected to the rotatable barrel to drive the rotatable barrel to rotate and simultaneously move up and down in the first chamber.

9. The grinding device of claim 8, wherein a total length of the threaded shaft and the rotatable barrel is longer than that of the first chamber.

10. A grinding device, comprising:

a fixed barrel comprising a first main body, the first main body being hollow and comprising a top plate and a bottom plate, the first chamber having a first opening formed in the bottom plate, the interior of the first main body defining a first chamber, the first chamber bounded by a plurality of sidewalls of the first main body, each of the sidewalls at the first chamber defining a holding groove therein for holding a workpiece;

a rotatable barrel received in the first chamber and comprising two first outer sides, each of the first outer sides being substantially parallel to an axis of the rotatable barrel and defining an installation groove;

a grinding plate mounted in each of the installation grooves;

an actuator drivably connected to the rotatable barrel to cause the rotatable barrel to rotate and simultaneously move up and down in the first chamber such that the grinding plates contact surfaces of the workpieces and grind the surfaces of the workpieces into desired arc shapes; and a cleaning assembly comprising a housing and a pipe, the housing defining a receiving chamber, the housing comprising a top on which the fixed barrel is fixed and a peripheral sidewall, the receiving chamber communicating with the first opening of the first chamber, the peripheral sidewall defining a second opening, the pipe connected to the peripheral sidewall at the second opening such that the pipe communicates with the receiving chamber, and the pipe capable of conveying liquid into the receiving chamber and the first chamber to clean the workpieces.

11. The grinding device of claim 10, wherein the first main body is hollow and comprises a top plate, a plurality of suction holes span from the bottom of the holding groove to the top plate of the fixed barrel, each of the suction hole communicating one of the holding grooves to a vacuum source via an airway to fixedly hold the workpiece in the holding groove.

12. The grinding device of claim 10, wherein the rotatable barrel comprises two opposite second sides surfaces, a second main body and an inner tube, the inner tube is formed in the second main body, the second main body and the inner tube cooperatively define a water chamber therebetween, a water nozzle protrudes outwards from each of the second side surfaces, the water nozzle communicates with the water chamber to spray water on the workpieces when being grinded.

13. The grinding device of claim 12, wherein the inner tube defines a grease chamber, the rotatable barrel further comprises two opposite third side surface, a grease nozzle protrudes outwards from each of the third side surfaces the grease nozzle communicates with the grease chamber, the grease nozzle communicates with the grease chamber to spray grease on the workpieces when the workpieces are grinded.

14. The grinding device of claim 10, wherein the grinding plate comprises an arc abrading surface for grinding the workpieces when the grinding plates are moved and rotate to contact with the workpieces.

15. The grinding device of claim 10, wherein the cleaning assembly further comprises a vibrating member mounted on another side surface of the receiving chamber, and configured to vibrancy water in the fixed barrel to clean the workpieces.

16. The grinding device of claim 15, wherein the vibrating member is an ultrasonic device.

17. The grinding device of claim 11, wherein the fixed barrel defines a threaded hole in the middle of a top plate of the fixed barrel, a threaded shaft protrudes upwardly from the rotatable barrel along the central axis, the threaded shaft engages with and passes through the threaded hole of the fixed barrel, the threaded shaft are rotatably fixed to the actuator, and the actuator rotates and moves the rotatable barrel up and down in the first chamber to grind the workpieces.

18. The grinding device of claim 17, wherein the total length of the threaded shaft and the rotatable barrel is longer than that of the first chamber.

* * * * *